United States Patent [19]

Norlin

[11] Patent Number: 5,027,865

[45] Date of Patent: Jul. 2, 1991

[54] CONTROLLABLE HYDRAULIC PICKING DEVICE

[76] Inventor: Göran Norlin, P.O. Box 40, 343 00 Älmhult, Sweden

[21] Appl. No.: 362,539

[22] Filed: Jun. 7, 1989

[51] Int. Cl.[5] ..... D03D 49/42

[52] U.S. Cl. ..... 139/142; 60/371; 60/413; 139/144

[58] Field of Search ..... 139/142, 141, 143, 144, 139/435.1; 60/413, 371

[56] References Cited

U.S. PATENT DOCUMENTS

| | | | |
|---|---|---|---|
| 3,977,442 | 8/1976 | Shibata et al. | 139/435 |
| 4,244,401 | 1/1981 | Gustafsson | 139/142 |
| 4,651,785 | 3/1987 | Volland et al. | 139/435 |
| 4,877,064 | 10/1989 | Pezzali | 139/452 X |

FOREIGN PATENT DOCUMENTS

| | | | |
|---|---|---|---|
| 0054844 | 6/1982 | European Pat. Off. | 139/142 |
| 732909 | 6/1955 | United Kingdom | 139/142 |

*Primary Examiner*—Andrew M. Falik

*Attorney, Agent, or Firm*—Pollock, Vande Sande & Priddy

[57] ABSTRACT

A pick device is incorporated in a weaving machine for the shuttles. The device comprises an accumulator for a working medium which can be filled into and emptied out of the accumulator and a pick-executing unit is incorporated, which performs its pick operation upon actuation by the working medium during emptying of the working medium out of the accumulator. A regulating member varies the effect of the working medium on the unit as a function of signals received for a controlling unit, thereby providing a predetermined pick force to the pick-executing unit.

18 Claims, 5 Drawing Sheets

CONTROLLABLE HYDRAULIC PICKING DEVICE

BACKGROUND OF THE INVENTION

The present invention relates to a pick device intended for the shuttle of a weaving machine and comprising an accumulator for a working medium, for example hydraulic oil, which can be filled into and emptied out of the accumulator. A pick-executing unit is also incorporated, which performs its pick-executing as a result of the emptying of the working medium out of the accumulator.

In weaving machines it is previously known to use hydraulically operating pick devices, with which the shuttles of the weaving machine are thrown or pushed through the warp between their positions in the shuttle boxes. The known pick devices comprise an accumulator which can be charged with hydraulic oil by means of a hydraulic pump, which is connected to the accumulator via a nonreturn valve. The hydraulic oil is pumped into the accumulator by means of the hydraulic pump, whose executed pump pressure determines the pick force.

The shuttles push through the warp, and between both sides of the fabric, weft threads of varying quality and size, which creates different resistances for the shuttles. Moreover, weave patterns depending on the number of threads on the race plate give different resistances for the shuttles.

This means that the known pick device must be dimensioned so as to provide sufficient impact for the shuttle or shuttles connected to the thread or threads giving the greatest resistance. The shuttle concerned must be given a speed which allows the shuttle to reliably reach the catch side at the same time as which the weaving process can be carried through at an optimum rate.

The abovementioned means that a shuttle or shuttles with low resistance to their weft threads reach the catch side at speeds which can result in problems and, for example, cause rebounding at the catch side and, thus, stoppage of the weaving machine during ongoing weaving. Shuttles and shuttle boxes may also be subjected to undue mechanical effects, wear, and the like.

SUMMARY OF THE INVENTION

The aim of the present invention is to provide a pick device which solves the problems mentioned above. The feature which can principally be regarded as being characteristic of the new pick device is that a regulating member is designed so as to vary, as a function of controls or settings, the effect of the working medium on the unit, so that the latter provides a pick force dependent on the controls or settings.

In one embodiment the regulating member is arranged in a connection between the accumulator and the unit. The regulating member varies the passage area of the working medium in the connection as a function of the controls or settings.

In a preferred embodiment the regulating member comprises one or more sphere-shaped members, such as ball valves arranged consecutively in the connection and having through passages which, as a function of the controls, assume different angular settings in relation to the other passage(s) of the connection. Each sphere-shaped member can be designed self-centering and each angular setting of the passage of the sphere-shaped member in relation to the other passage can be effected against the action of a restoring force.

For the angular control of each sphere-shaped member a first rack can be used which engages with a gear wheel which is firmly connected to the sphere-shaped member and which, when acted upon by the first rack, turns the sphere-shaped member. In one embodiment the self-centering function can be brought about by means of the the first rack. Alternatively, a second rack can be used which is situated in engagement with the gear wheel and can thus be acted upon by the latter when the gear wheel is turned by means of the first rack. The actuation of the second rack by the gear wheel can be effected against the action of a resistance pressure.

The amount of movement of the first rack can preferably be set by means of one or more adjusting screws which are arranged at one end or both ends of the first rack.

The accumulator is connected to a working medium pump through a nonreturn valve. The outputs of the accumulator and the pump (or rather the nonreturn valve) are connected to the pick unit through the regulating member. The regulating member is controlled by a hydraulic pressure and the control circuits are connected to the said outputs of the accumulator and the nonreturn valve through a first valve body. The self-regulating function is also controlled by means of the pressure (system pressure) at the said outputs.

The actuation of the pick unit, due to the emptying of the accumulator, is effected by means of a second valve. The first and second valves are preferably electrically controlled and can be made up of solenoid valves. The pump and the first and second valves can be controlled from a common controlling unit. The control member is controlled preferably in such a way that each sphere-shaped member is turned between end positions which can be defined by means of end position-determining members which can be made up of manually actuable adjusting screws.

By means of the present invention device, a technically reliable apparatus is obtained for variation of the pick force of the pick unit. The pick force for each shuttle can be adapted in relation to the resistance which the thread or threads of the shuttle is/are expected to offer during the overshoot. In this way all the shuttles can be given essentially the same speed at the catch side independent of thread resistance, patterns, and the like.

The control can be effected automatically during ongoing weaving and the control as such can utilize, for example, end position controls. The controlling unit can be made programmable so that a specific shuttle with specific yarn (thread) acquires the correct pick force.

BRIEF DESCRIPTION OF THE DRAWINGS

In the following various embodiment of a pick device, which exhibits the features relevant to the invention, will be described below with reference to the drawings in which.

DETAILED DESCRIPTION OF THE PREFERRED EMBODIMENTS

Figure 1:
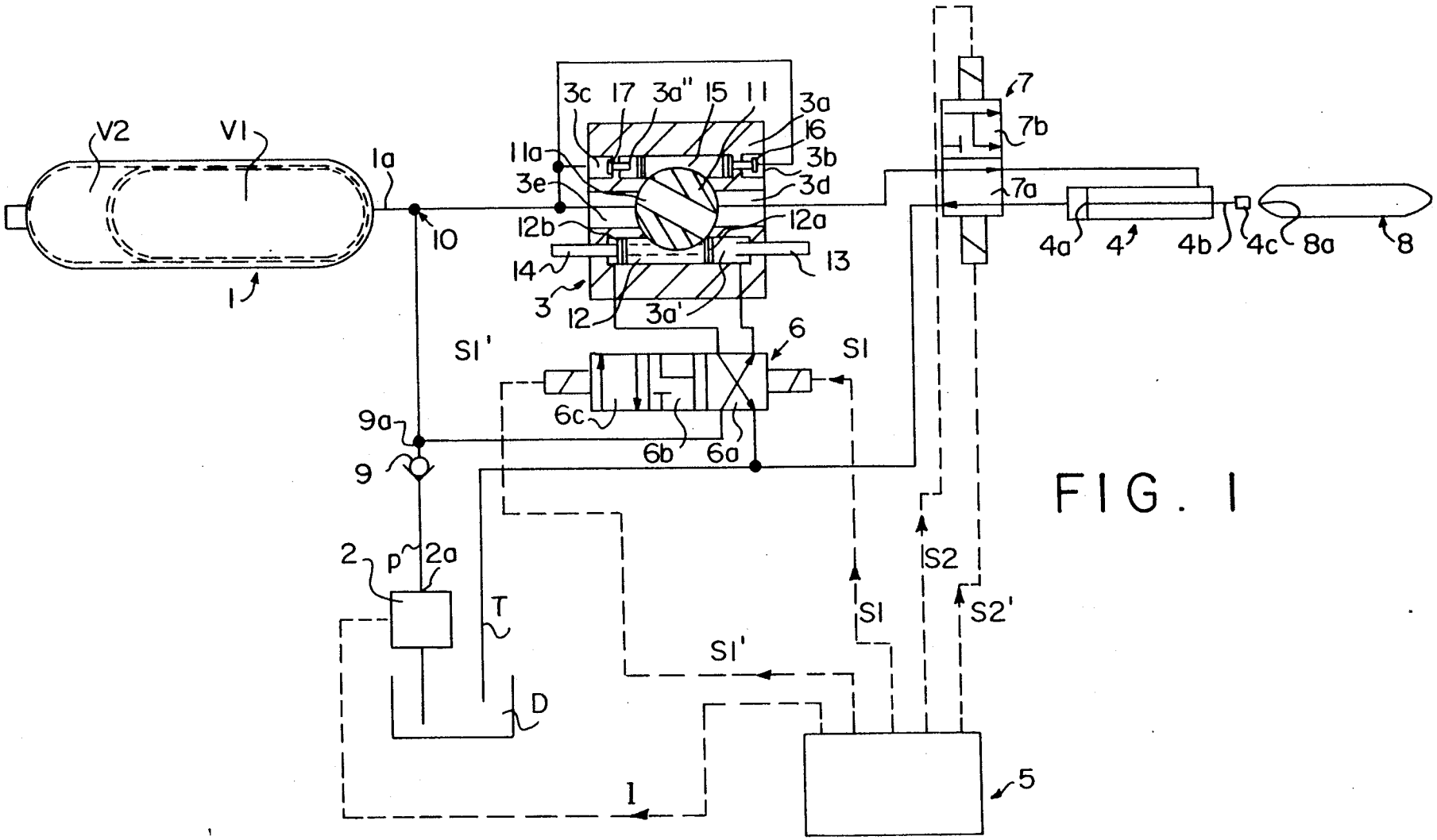
FIG. 1 shows, in a diagram, the apparatus of the present invention including the accumulator, pump, regulating member and pick unit, incorporated into a device and connected to a shuttle and a controlling unit, FIGS. *2a–2b* show, in horizontal views, different angular positions of a sphere-shaped member incorporated in the regulating member.

The pick device, according to the present invention comprises the following principal parts: an accumulator 1, a pump 2, a regulating member (regulating valve) 3, a pick-executing unit 4 and a controlling unit 5. The regulating member 3 can be controlled by means of a first valve 6. The release of the pick unit 4 can be effected by means of a second valve 7. Both valves are electrically controlled and are made up of solenoid valves of known type and receive control signals from the unit 5. The pick unit is intended to effect a pick force, depending on controls, for the shuttles in a weaving machine. In FIG. 1 the shuttles are represented by a shuttle 8.

The working medium employed in the present case is a hydraulic oil. The accumulator 1 can be charged with hydraulic oil from the pump 2 which is connected to the accumulator through a nonreturn valve 9. In the hydraulic system shown in FIG. 1 the pressure lines are shown by P and the return line by T. The accumulator is of the type which has a variable volume which, in FIG. 1, has been symbolized by V1 for the volume of the non-filled accumulator and V2 for the volume of the filled accumulator. The outputs of the pump 2*a* through nonreturn valve 9*a* and of the accumulator (1*a*) are connected (joined together) at the connection point designated by 10. The regulating member comprises a sphere-shaped member 11 which is controllable by means of a first rack 12 between two adjustable end positions. The rack is in engagement with the member 11. The rack is displaceably arranged in a space 3*a'* which functions as a cylinder volume in the framework 3*a* of the member 3 and can be actuated system pressure which can be coupled to either of the ends 12*a* and 12*b* of the rack which in principle are designed as pistons operating in the cylinder volume. The coupling of the system pressure is effected by means of the first valve 6 which is a three-position valve. In FIG. 1 the rack is shown in its first end position in which the system pressure through the valve 6 acts on the first end 12*a* (the piston). The cylinder volume 3*a'* for the first rack is connected, at the other end 12*b* (piston) of the rack, to the drainage D through the valve 6. In an intermediate position of the valve, the spaces on either side of the ends 12*a* and 12*b* of the rack are connected to the drainage D. In a third position of the valve 6, the space 3*a'* at the end 12*b* is connected to the system pressure, and the space at the end 12*a* is connected to the drainage D. The end positions of the first rack can be determined by means of end position-determining members which, in the present case, are manually settable adjusting screws 13 and 14.

The sphere-shaped member 11 is also self-centering. In the preferred embodiment shown, the self-centering is effected by means of a second rack 15. The second rack is connected or is in engagement with the sphere-shaped member and, when the latter is turned by means of the first rack 12, a displacement action is exerted on the second rack 15. The second rack is, in the same way as the first rack 12, mounted in a space 3*a''* in the framework 3*a* of the regulating member 3. The framework is provided with two recesses 3*b* and 3*c* which are each connected to the system pressure at point 10. In passages between the said spaces 3*b* and 3*c* and the bearing space of the second rack there are arranged members 16 and 17 with widened parts (heads) located in the spaces 3*b* and 3*c* and pin-shaped parts which extend in the passages into the space 3*a''* in order to cooperate, via their ends, with the ends of the second rack. The members 16 and 17 are displaceable by means of each piston-shaped end on the second rack against the action of a force which is generated by the actuation of the system pressure on each widened part of the members 16, 17. The area of each widened part is considerably less than the respective area of the ends 12*a*, 12*b* of the first rack. The force exerted by the coupled system pressure on each piston end 12*a*, 12*b* exceeds the resistance force generated by the system pressure on each member 16, 17 which thus yields when the system pressure is coupled on each piston end 12*a*, 12*b*. When the system pressure ceases or is uncoupled from each piston end, the second rack, and with it the sphere-shaped member, is returned to its middle position by the force on each member 16, 17. The working medium is fed in and withdrawn via the passages between the spaces 3*a''* and 3*b*/3*c* into and out of the space during the movements of the second rack between its end positions. The members 16, 17 are assigned end position stops (not shown separately) which maintain the members in the said passages serving as member-bearing holes.

In this manner the system pressure can be used to return the sphere-shaped member 11 to a starting position which, in the case shown, constitutes a middle position. This means that the sphere-shaped member 11 is located in the middle position when no control effect is present. When a control effect is present, the sphere-shaped member is located in one of the two angular end positions. The sphere-shaped member 11 is designed with a passage 11*a* which, in the middle position, coincides with other passage parts 3*d* and 3*e* in the regulating member framework 3*a*. In the middle position the throughflow passage is maximal. In the said end positions the passage 11*a* is oblique relative to the other passage parts 3*d* and 3*e*. In this way a reduced or throttled throughflow area for the system medium is achieved when the latter is emptied from the accumulator and passes the regulating member 3 towards the pick unit 4. The pick unit 4 is made up of a hydraulic cylinder whose piston is symbolized by 4*a* and whose piston rod is symbolized by 4*b*. Arranged on the end of the piston rod 4*b* is a pick part 4*c* by means of which the piston rod can cooperate with part 8*a* on the shuttle 8.

The pick execution is triggered by means of the valve 7 which operates with the positions 7*a* and 7*b*. The position 7*a* is an emptying position in which the underside of the piston 4*a* is connected to the drainage line T and the topside of the piston is connected to the system pressure. The piston is thus returned to its starting position by means of the system pressure. In the position 7*b* both the underside and the topside of the piston are connected to the system pressure, in which respect the difference in the piston area gives rise to the pick movement.

The procedure is as follows. The accumulator 1 is charged by means of the pump 2. The pump receives a continuous or intermittent controlling signal I from the controlling unit 5. During the charging the sphere-shaped member 11 can be allocated a first control signal S1 which causes the valve 6 to assume its first end position 6*a* in which the system pressure is connected to the end 12*a* of the first rack 12. A second control signal S1' causes the valve 6 in the same way to assume its second end position 6*c*. When no signal is emitted, the valve 6 assumes its middle position 6*b*. When the accumulator reaches the appointed degree of charging, which is determinable by the pump pressure, it can be released or caused to emit its medium by means of the valve 7, when the latter receives a control signal S2 from the controlling unit 5. The valve 7 assumes the position 7*b* when the accumulator and pump outputs connected at 10 are connected to the unit 4 through the regulating member 3. The pressure difference on the top and underside of the piston which thus arises causes the pick part 4*c* to strike against the shuttle end 8*a*. The arrangement results in a sufficient amount of hydraulic oil being fed into the cylinder 4, and the variation obtained by means of the sphere-shaped member results in a pick of suitable predetermined force being achieved against the shuttle end. After the pick, the valve 7 is caused to move to its position 7*a* in which the piston 4*a* returns to the starting position. The sphere-shaped member may retain its assumed position or be caused to assume, by means of a new control signal, its second end position depending on the thread (yarn) for a future shuttle, pattern, and the like. During the return of the cylinder to the starting position, the accumulator 1 is again filled. In one preferred embodiment the pump operates continuously and effects a chosen predetermined pressure during its functioning. The pick device can effect picks giving the shuttles speeds of between, for example 10–25 m/sec. The accumulator ensures that sufficient medium volume/time unit is achieved for each pick. The pick device can execute pick forces of between 150N–450N. The consumption of medium for each pick is about 0.15 liter.

The controlling unit can be designed using known technology, so that controls of the pump 2 and/or the valves 6 and 7 are realized. In the controlling member the pattern, thread type, shuttle speed, pick forces and other parameters essential for weaving can be programmed. The unit can thus be designed in such a way that it gives a control signal, depending on the weaving parameters, to the pump and/or the valves.

Figure 2A:
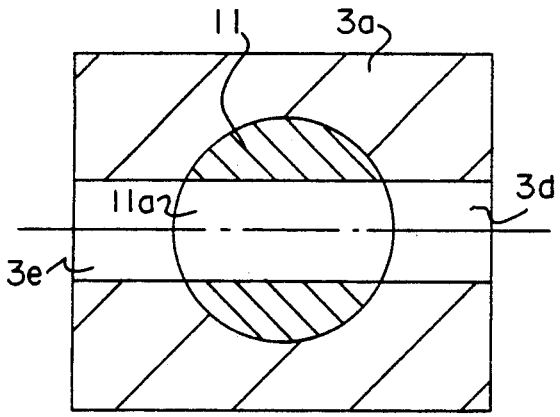

FIG. 2*a* shows in principle the setting of the sphere-shaped member 11 in the middle position, in which respect the through recess or hole 11*a* of the member 11 is aligned with other through passages 3*e* in the framework 3*a*.

Figure 2B:
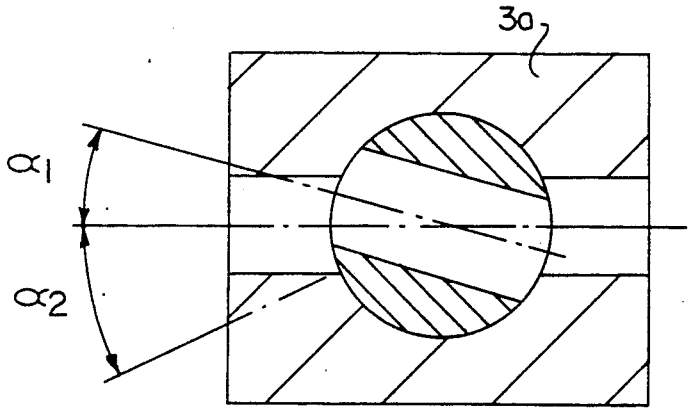

FIG. 2*b* shows two angular positions $\alpha 1$ and $\alpha 2$. In the first position or the first end setting angle $\alpha 1$, the sphere-shaped member is turned less than in the second position or the second end setting angle $\alpha 2$. In this way different throughflow passages are obtained in the two end angle positions.

Figure 3:
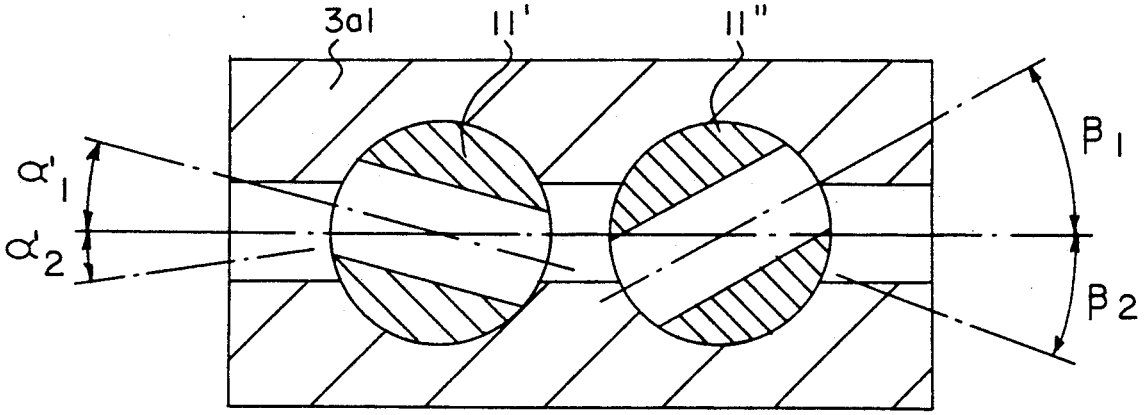
FIG. 3 shows, in a diagram, an alternative embodiment of the regulating member according to FIG. 1, in which the regulating member comprises two sphere-shaped members (instead of one) arranged consecutively.

FIG. 3 shows two consecutively arranged sphere-shaped members 11' and 11''. Given that there are three different positions, the end positions and the middle position for each sphere-shaped member, with two sphere-shaped members nine different end setting possibilities are obtained for the throughflow area. The sphere-shaped members can be turned to the same extent or to different extents in order to assume their respective end positions. The sphere-shaped member 11' can assume the end angle positions $\alpha 1'$ and $\alpha 2'$. The second sphere-shaped member 11'' can assume the end angle positions $\beta 1$ and $\beta 2$, which in this respect differ from $\alpha 1'$ and $\alpha 2'$. The regulating member 3 can be designed with further sphere-shaped members in series, in which connection an additional number of positions is achieved.

Figure 4:
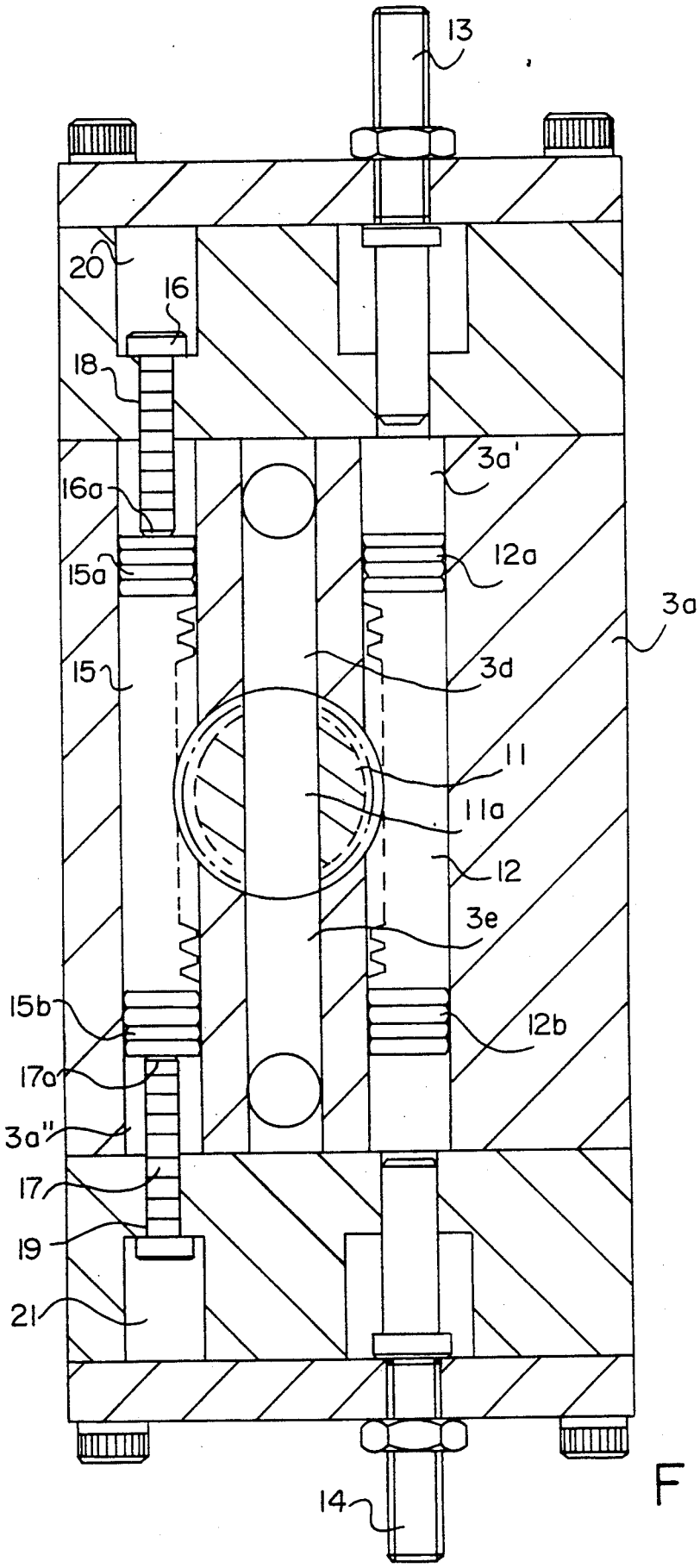
FIG. 4 shows, in horizontal view, parts of the regulating member according to FIG. 1.

FIG. 4 shows on an enlarged scale an embodiment of the regulating member 3. The end position-determining members 13 and 14 are manually settable adjusting screws. In the middle position of the sphere-shaped member 11, that is the position according to FIG. 4, the members 16 and 17 lie with their respective end 16*a*, 17*a* against the end faces of the second rack at the ends 15*a* and 15*b* respectively. As soon as the first rack is subjected to a control pressure in accordance with the above in the one direction, the second rack moves in the opposite direction. The member 16, 17 in question is therefore moved, and the control of the sphere-shaped member 11 thus takes place against the action of a resistance pressure which is generated as a result of the action of the system pressure on each member 16, 17. The resistance pressure or system pressure is connected through recesses 20 and 21. The sphere-shaped member is provided with one or more gear wheels, by means of which the sphere-shaped member can be rotated by the first and second rack. By means of setting the members 13 and 14, the first rack can be made movable between different end positions. Each end position corresponds to a certain throughflow area in the unit and, thus, to a certain pick force from the cylinder 4.

Figure 5:
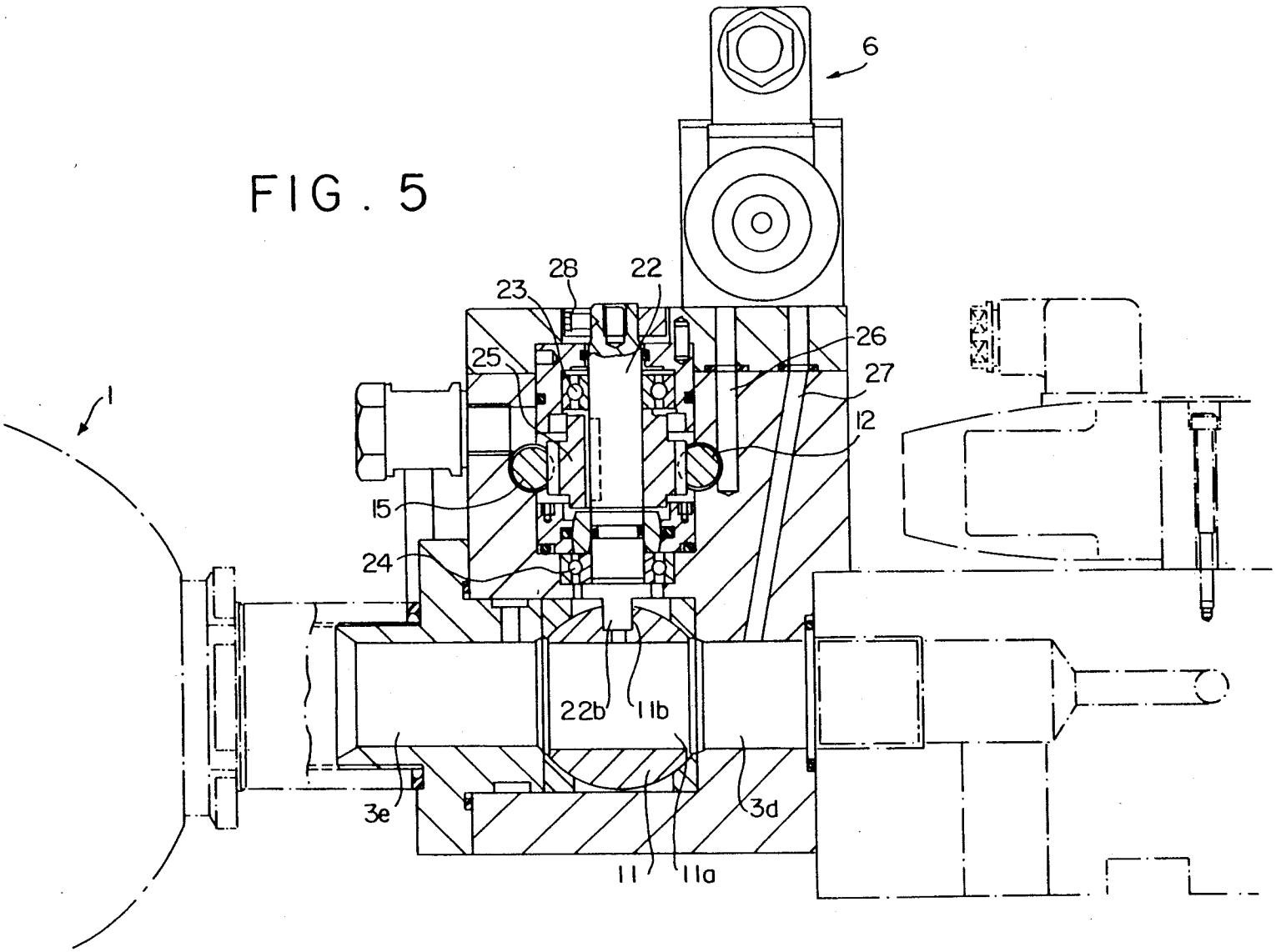
FIG. 5 shows, in vertical view, the regulating member according to FIG. 1.
Figure 6:
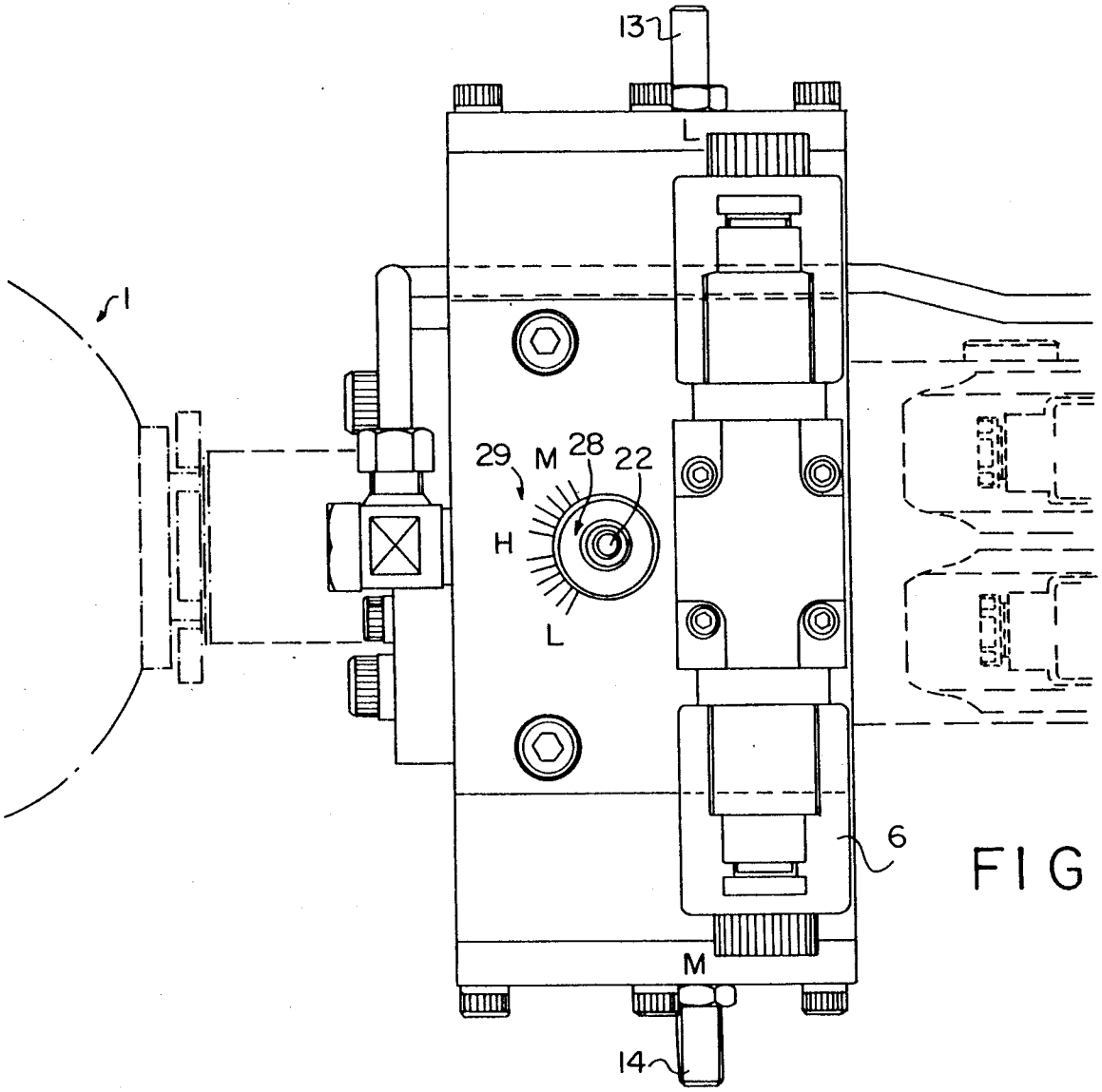
FIG. 6 shows, in horizontal view, the regulating member according to FIG. 1.

FIGS. 5 and 6 show a constructive preferred embodiment. The figures show how the rotational actuation of the sphere-shaped member 11 can be effected. The sphere-shaped member is provided with a groove 11*b* such as screw groove. An axle 22 is mounted in ball-bearings 23 and 24. A gear wheel 25 is in turn secured rotationally-fixed on the axle and lying in engagement with the racks 12 and 15. The axle bears at its end an elongate part extending in the downward direction in the plane of the FIG. 22*b* screwdriver. When the axle is turned by means of the racks 12 and 15, turns are obtained in accordance with FIGS. 2*a* and 2*b*. An inlet channel for the space 3*a'* (see FIG. 1) is indicated by 26, and the channel 27 is incorporated in the hydraulic system according to FIG. 1. An indicating member 28 is fixed on the axle at its upper end. In FIG. 6 the indicating member is seen with respect to three positions M medium, H and L, light. The upper adjusting screw 13 can thus be used for setting a light pick, and the lower adjusting screw can be used for setting a medium pick. When the control member is not actuated, a hard pick is obtained. The indicating member 28 cooperates with a scale 29. The scale can consist of lines with a graduation of, for example, 10°.

By means of the above the shuttle can be given picks of different pick forces and, in this way, approximately the same speed of the shuttle is obtained at the catch side independent of the resistance which the shuttle meets during the overshoot. The adaptation of the pick force is carried out by means of tests and/or on the basis of experience. The pick force is set with both pump pressure as accumulator effect and passage throttling setting. The regulating member is made up in the above case of an adjustable ball valve (throttle). The ball valve unit consists in principle of a known ball from a ball valve, whose controlling axle is provided with a gear wheel which is turned by means of a first rack in one or other direction and is returned to the centered position by a second rack. When the solenoid valve 6 does not receive any electrical signal, the ball stands in the centered position and a hard pick against the shuttle is obtained from the cylinder 4. Upon electrical control of the one coil of the solenoid valve, a control which corresponds to a medium pick, the ball turns over into the medium position and a medium-hard pick is obtained. The size of the angle for the medium pick can be adjusted by means of the adjusting screw 14 to a maximum angle of, for example, 60°. The same applies to the light pick. By means of the described arrangement, it is thus possible to obtain, from the same pick unit, for example three different pick forces. In the case where this is not sufficient, nine different pick forces can be obtained by series connection of two balls. In the cases mentioned, a programming of the pick force is carried out in the controlling unit according to the pattern, so that a specific shuttle which contains a specific yarn (thread) acquires the correct pick force. The level of the pick force is determined by the pump pressure and by the centered position of the ball valve valves.

The invention is not limited to the embodiment shown above by way of example, but can undergo modifications within the scope of the subsequent patent claims and the inventive concept.

I claim:

1. Pick device for a shuttle of a weaving machine comprising:

an accumulator for containing a working medium which can be filled into and emptied out of the accumulator;

a pick-executing unit operatively connected to said accumulator for picking a shuttle upon actuation by said working medium delivered from said accumulator during emptying of the accumulator; and a regulating member provided in a connection passage between the accumulator and the pick-executing unit for providing a predetermined pick force for the pick-executing unit by varying a passage area of the working medium in said connection passage as a function of predetermined controlling signals from a controlling unit.

2. The device according to claim 1, wherein said regulating member includes at least one sphere-shaped member positioned in said connection passage and being rotatable by rotation effecting means, said sphere-shaped members having through passages which, in response to the signals from the controlling unit, assume different angular positions with respect to said connection passage.

3. The device according to claim 1, wherein said regulating member includes a plurality of sphere-shaped members being rotatable by rotation effecting means and positioned consecutively in said connection and having a through-passage which, in response to the signals from the controlling unit, assume different angular positions with respect to said connection passage.

4. The device according to claim 2, wherein each angular position setting of the passage of said sphere-shaped member in relation to the other passage of said connection is effected against the action of a restoring force, to provide self-centering of each sphere-shaped member with respect to a starting position/middle position.

5. The device according to claim 2, wherein each sphere-shaped member is controllable by means of said working medium which acts on said sphere-shaped member through a first rack which is positioned is engagement with a gear wheel which is connected to said sphere-shaped member and effects rotation of said sphere-shaped member.

6. The device according to claim 3, wherein a pump is connected to said regulating member through a non-return valve, for filling said accumulator with said working medium, and wherein said pump is connectable in parallel to said pick-executing unit through said regulating member.

7. The device according to claim 2, wherein the coupling of outputs of said accumulator and said pump are effected by means of a second valve.

8. The device according to claim 5, wherein each sphere-shaped member is controllable by means of said working medium which acts on said sphere-shaped member through a first rack which is in engagement with a gear wheel which effects the rotation of the sphere-shaped member and is connected to the sphere-shaped member.

9. The device according to claim 4, wherein the coupling of outputs of said accumulator and said pump are effected by means of a second valve.

10. The device according to claim 5, wherein the self-centering function is produced by means of said first rack, or a second rack, which is in engagement with the gear wheel for actuation by the gear wheel when it is turned by said first rack, the actuation of the second rack by the gear wheel being effected against the action of a resistance pressure.

11. The device according to claim 5, wherein said first rack is arranged to cooperate with adjusting screws at least at one end thereof for determining an end position of the first rack and the magnitude of the rotational movement of said sphere-shaped member as a function of the control signals.

12. The device according to claim 5, wherein the coupling of outputs of said accumulator and said pump are effected by means of a second valve.

13. The device according to claim 10, wherein the first rack is adapted to cooperate with adjusting screws at its at least one end for determining the end position of the first rack, and thereby determining the magnitude of the rotational movement of said sphere-shaped member as a function of the controlling signals.

14. The device according to claim 11, further comprising a pump for filling said accumulator with said working medium connected to said regulating member through a non-return valve and wherein said pump is further connectable in parallel to the pick executing unit through said regulating member.

15. The device according to claim 11, wherein a pump is connected to said regulating member through a non-return valve, for filling said accumulator with said working medium, and wherein said pump is connectable in parallel to said pick-executing unit through said regulating member.

16. The device according to claim 14, wherein outlets of said accumulator and said pump for delivering said working medium are connected to control inputs of said regulating member through a first valve for controlling a self-centering function of said sphere-shaped member.

17. The device according to claim 1, wherein outputs of said accumulator and of a pump are coupled by means of a second valve.

18. The device according to claim 16, wherein the coupling of outputs of the accumulator and the pump are effected by means of a second valve.

* * * * *